US009936815B2

(12) United States Patent
DeMoss et al.

(10) Patent No.: US 9,936,815 B2
(45) Date of Patent: Apr. 10, 2018

(54) POCKET COIL SPRING ASSEMBLY INCLUDING FLEXIBLE FOAM

(71) Applicant: Sealy Technology, LLC, Trinity, NC (US)

(72) Inventors: Larry K. DeMoss, Greensboro, NC (US); Darin T. Thomas, Salisbury, NC (US); Brian M. Manuszak, Thomasville, NC (US); Stephen Wallace, Duffield, VA (US)

(73) Assignee: Sealy Technology, LLC, Trinity, NC (US)

( * ) Notice: Subject to any disclaimer, the term of this patent is extended or adjusted under 35 U.S.C. 154(b) by 10 days.

(21) Appl. No.: 14/717,245

(22) Filed: May 20, 2015

(65) Prior Publication Data

US 2015/0342362 A1 Dec. 3, 2015

Related U.S. Application Data

(60) Provisional application No. 62/005,361, filed on May 30, 2014.

(51) Int. Cl.

| | |
|---|---|
| ***A47C 23/04*** | (2006.01) |
| ***A47C 27/20*** | (2006.01) |
| ***A47C 27/05*** | (2006.01) |
| ***A47C 27/045*** | (2006.01) |
| ***A47C 27/06*** | (2006.01) |

(52) U.S. Cl.

CPC ..... *A47C 27/20* (2013.01); *A47C 23/04* (2013.01); *A47C 27/0456* (2013.01); *A47C 27/056* (2013.01); *A47C 27/064* (2013.01)

(58) Field of Classification Search

CPC ..... A47C 23/04; A47C 27/20
USPC ..... 5/716, 718, 720, 655.8, 655.7
See application file for complete search history.

(56) References Cited

U.S. PATENT DOCUMENTS

| | | | | |
|---|---|---|---|---|
| 3,869,739 | A * | 3/1975 | Klein | A47C 27/064 5/718 |
| 4,439,977 | A | 4/1984 | Stumpf | |
| 4,609,186 | A | 9/1986 | Thoenen | |
| 5,222,264 | A * | 6/1993 | Morry | A47C 27/063 267/81 |
| 6,260,223 | B1 | 7/2001 | Mossbeck et al. | |
| 7,185,379 | B2 | 3/2007 | Barman | |
| 7,805,790 | B2 | 10/2010 | DeMoss | |
| 7,908,693 | B2 | 3/2011 | DeMoss | |
| 8,895,109 | B2 † | 11/2014 | Cohen | |
| 9,060,616 | B2 | 6/2015 | Cohen | |

* cited by examiner
† cited by third party

*Primary Examiner* — Fredrick C Conley
(74) *Attorney, Agent, or Firm* — Middleton Reutlinger

(57) ABSTRACT

A pocket coil spring assembly is provided that includes a coil spring having an upper portion and a lower portion collectively defining an interior cavity of the coil spring. The pocket coil spring assembly further includes a fabric pocket encasing the coil spring with a top area covering the upper portion of the coil spring and a bottom area covering the lower portion of the coil spring. An amount of flexible foam is positioned in the interior cavity of the coil spring such that a top surface of the flexible foam extends above the coil spring. A mattress assembly is further provided that includes a plurality of the pocket coil spring assemblies.

19 Claims, 5 Drawing Sheets

POCKET COIL SPRING ASSEMBLY INCLUDING FLEXIBLE FOAM

RELATED APPLICATIONS

This application claims priority to U.S. Provisional Application Ser. No. 62/005,361 filed May 30, 2014, the entire disclosure of which is incorporated herein by this reference.

TECHNICAL FIELD

The present invention relates to pocket coil spring assemblies. In particular, the present invention relates to pocket coil spring assemblies that include an amount of flexible foam positioned in an interior cavity of the coil spring and having a top surface that extends above the coil spring.

BACKGROUND

Spring assemblies that make use of pocket coil springs, which are also known as wrapped coils, encased coils, encased springs, or Marshall coils, are generally recognized as providing a unique feel to a mattress when used as a part of a spring assembly because each discrete coil is capable of moving independently to support the body of a user, or a portion thereof, resting on the mattress. In particular, in pocket coil spring assemblies, each coil is wrapped in a fabric pocket and moves substantially independently of the other coils in the pocket coil spring assembly to thereby provide individualized comfort and contouring to the body of a user. Moreover, as a result of moving substantially independently from one another, the pocket coils also do not directly transfer motion from one pocket coil to another, such that the movement of one user resting on a mattress assembly using pocket coils will not disturb another user resting on the mattress assembly. In this regard, mattress assemblies constructed with pocket coil springs are generally recognized as providing a soft and luxurious feel, and are often more desirable than a traditional inner spring mattress. Accordingly, a pocket coil spring assembly that improves the unique feel and support provided by traditional pocket coil springs would be both highly desirable and beneficial.

SUMMARY

The present invention includes pocket coil spring assemblies. In particular, the present invention includes pocket coil spring assemblies that include an amount of flexible foam positioned in an interior cavity of the coil spring and having a top surface that extends above the coil spring.

In one exemplary embodiment of the present invention, a pocket coil spring assembly includes a coil spring having an upper portion and a lower portion which collectively define an interior cavity of the coil spring. The pocket coil spring assembly further includes a fabric pocket that encases the coil spring, with a top area that covers the upper portion of the coil spring and a bottom area that covers the lower portion of the coil spring, such that the top area of the fabric pocket and the bottom area of the fabric pocket collectively cover the outside of or encase the coil spring. Further included in the pocket coil spring assembly is an amount of flexible foam that is positioned in the interior cavity of the coil spring and that has a top surface that extends above the coil spring.

With further respect to the fabric pocket, the top area of the fabric pocket is connected to the bottom area of the fabric pocket within the interior cavity of the coil spring. The top area of the fabric pocket can be connected to the bottom area of the fabric pocket by any number of means, including a tuft, a staple, a weld, and the like. The connection of the top area of the fabric pocket to the bottom area of the fabric pocket allows not only for the fabric pocket to impart a desired level of pre-compression, stability, and/or stretchability to the pocket coil spring assembly, but the connection within the interior cavity of the coil spring also creates a recess that is defined by the top area of the fabric pocket, and that extends into the interior cavity of the coil spring. The recess then, in turn, provides a suitable area into which the flexible foam can be directly dispensed and allowed to react and bond to the fabric pocket In another embodiment of the present invention, a spring core is provided that comprises a plurality of the above-described pocket coil spring assemblies arranged in a matrix. The plurality of pocket coil spring assemblies collectively define a first support surface (or sleep surface) of the spring core, and a second support surface of the spring core opposite the first support surface. In particular, in an exemplary spring core, the longitudinal axes of each of the pocket coil spring assemblies are arranged parallel and then connected to one another, such that the top surface of the flexible foam of each of the pocket coil spring assemblies forms, at least in part, the first support surface of the spring core, and the bottom area of each of the fabric pockets along with the lower portion of each coil spring forms the second support surface of the spring core. As a refinement to the present invention, in some embodiments, the spring core can further include a continuous sheet that extends across the upper portion of each of the plurality of coil springs.

In a further embodiment of the present invention, a mattress assembly is provided that includes one of the spring cores described above. In such an embodiment, in addition to the spring core, the exemplary mattress assembly further comprises an upper body supporting layer positioned adjacent to the first support surface of the spring core, and a lower foundation layer positioned adjacent to the second support surface of the spring core. A side panel extends between the upper body supporting layer and the lower foundation layer around the entire periphery of the spring core such that the plurality of the pocket coil spring assemblies included in the spring core is surrounded.

Further features and advantages of the present invention will become evident to those of ordinary skill in the art after a study of the description, figures, and non-limiting examples in this document.

DESCRIPTION OF EXEMPLARY EMBODIMENTS

The present invention includes pocket coil spring assemblies. In particular, the present invention includes pocket coil spring assemblies that include an amount of flexible foam positioned in an interior cavity of the coil spring and having a top surface that extends above the coil spring.

Figure 1:
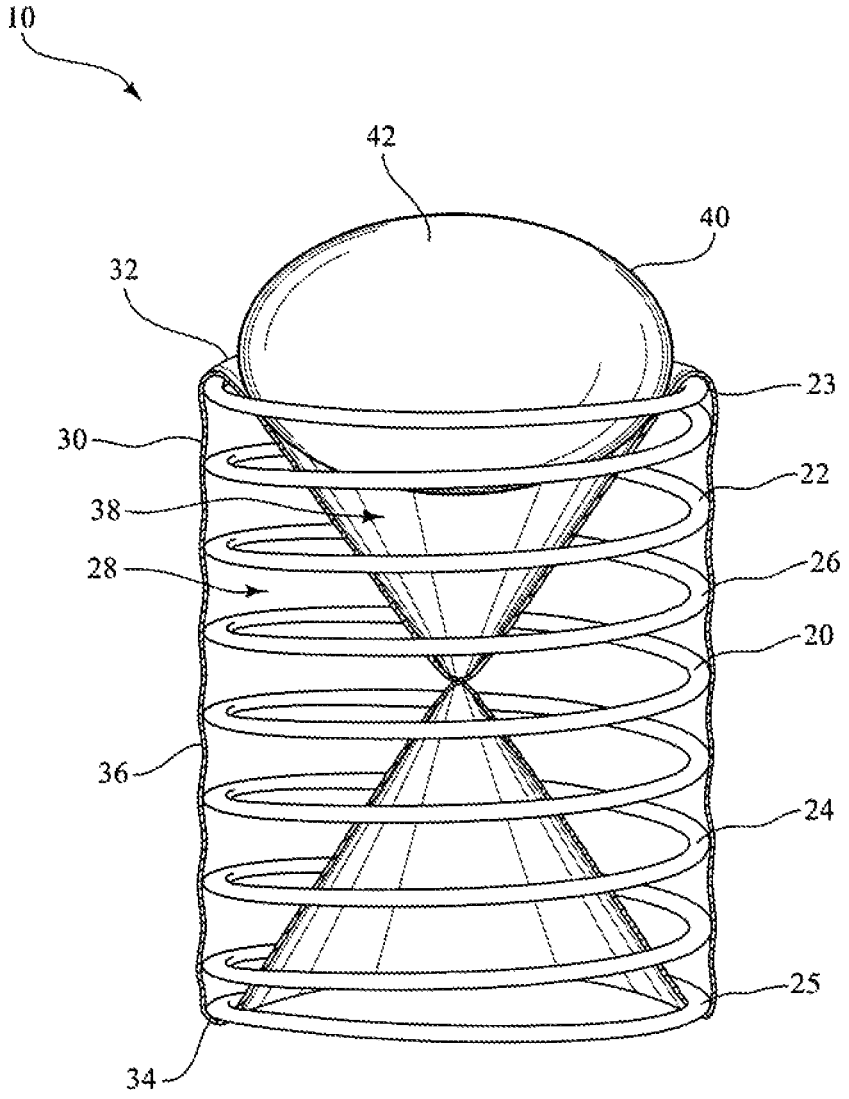
FIG. 1 is a side view of an exemplary pocket coil spring assembly made in accordance with the present invention with a portion of a fabric pocket of the pocket coil spring assembly removed to show a coil spring.

Referring first to FIG. 1, in one exemplary embodiment of the present invention, a pocket coil spring assembly 10 is provided that includes a coil spring 20 having an upper portion 22 and a lower portion 24 which collectively define an interior cavity 28 of the coil spring 20. The pocket coil spring assembly 10 further includes a fabric pocket 30 that encases the coil spring 20. Specifically, the fabric pocket 30 includes a top area 32 that covers the upper portion 22 of the coil spring 20, as well as a bottom area 34 that covers the lower portion 24 of the coil spring 20. Further included in the pocket coil spring assembly 10 is an amount of flexible foam 40 that is positioned in the interior cavity 28 of the coil spring 20 and that has a top surface 42 that extends above the coil spring 20.

With respect to the coil spring 20, the exemplary pocket coil spring assembly 10 shown in FIG. 1 includes a coil spring 20 made of a continuous wire that extends from an upper end convolution 23 at the upper portion 22 of the coil spring 20 to a lower end convolution 25 opposite the upper end convolution 23 at the lower portion 24 of the coil spring 20. In the coil spring 20, there are seven intermediate convolutions 26 that helically spiral between the upper end convolution 23 and the lower end convolution 25, such that the coil spring 20 is made of a total of nine convolutions or turns. Of course, various other springs, such as coil springs having a different number of convolutions, could also be used in an exemplary pocket coil spring assembly without departing from the spirit and scope of the present invention.

With respect to the fabric pocket 30, in the exemplary pocket coil spring assembly 10 shown in FIG. 1, the top area 32 and the bottom area 34 of the fabric pocket 30 extend along the outside of the coil spring 20 and form a generally cylindrical (or tubular) side surface 36 of the fabric pocket 30. In this regard, the fabric pocket 30 is preferably made of an inelastic fabric which can be joined or welded together by heat and pressure (e.g., via ultrasonic welding or by a similar thermal welding procedure) to form such a cylindrical structure. For example, suitable fabrics that can be used for the fabric pocket 30 can include one of various thermoplastic fibers known in the art, such as non-woven polymer-based fabric, non-woven polypropylene material, or non-woven polyester material.

With further respect to the fabric pocket 30 and referring still to FIG. 1, which shows a portion of the side surface 36 of the fabric pocket 30 removed to reveal the coil spring 20 and the interior of the pocket coil spring assembly 10, the top area 32 of the fabric pocket 30 is connected to the bottom area 34 of the fabric pocket 30 within the interior cavity 28 of the coil spring 20. The top area 32 of the fabric pocket 30 can be connected to the bottom area 34 of the fabric pocket 30 by any number of means, including a tuft, a staple, a weld, glue, stitches, clamps, hook-and-loop fasteners, and the like. By connecting the top area 32 of the fabric pocket 30 to the bottom area 34 of the fabric pocket 30 within the interior cavity 28 of the coil spring 20, not only is it possible to impart a desired level of pre-compression, stability, and/or stretchability to the pocket coil spring assembly 10, but the connection of the top area 32 of the fabric pocket 30 to the bottom area 34 of the fabric pocket 30 also creates a recess 38 that is defined by the top area 32 of the fabric pocket 30 and that extends into the interior cavity 28 of the coil spring 20 to about half of the total height of the coil spring 20. In the exemplary embodiment shown in FIG. 1, the top area 32 of the fabric pocket 30 is connected to the bottom area 34 of the fabric pocket 30 at approximately the center of the interior cavity 28 of the coil spring 20 forming a recess 38 having a substantially conical shape; however, it is of course appreciated that depending on how the top area 32 of the fabric pocket 30 is joined to the bottom area 34 of the fabric pocket 30, the recess 38 can also be formed with a different shape. For example, by increasing the size of the connected portion within the interior cavity 28 of the coil spring 20, a recess could be formed in the shape of a truncated cone, cylinder, or the like. Regardless of the particular shape of the recess 38, however, by joining the top area 32 of the fabric pocket 30 to the bottom area 34 of the fabric pocket 30, the recess 38 provides a suitable area into which a flexible foam 40 can be directly dispensed and allowed to react and bond to the fabric pocket 30.

Referring still to FIG. 1, the flexible foam 40 included in the pocket coil spring assembly 10 is generally comprised of a type of foam having a density suitable for supporting and distributing pressure from a user's body, or portion thereof, resting on the pocket coil spring assembly 10. Such flexible foams include, but are not limited to: latex foam; reticulated or non-reticulated visco-elastic foam (sometimes referred to as memory foam or low-resilience foam); reticulated or non-reticulated non-visco-elastic foam; high-resilience polyurethane foam; expanded polymer foams (e.g., expanded ethylene vinyl acetate, polypropylene, polystyrene, or polyethylene); and the like. In the exemplary embodiment shown in FIG. 1, the flexible foam 40 is comprised of a two-part polyurethane foam that can be dispensed as a liquid directly into the recess 38 defined by the top area 32 of the fabric pocket 30 to create a small, substantially spherical ball that reacts and bonds to the fabric pocket 30 itself and that includes a top surface 42 having a convex shape. Of course, it is appreciated that varying the composition of the liquid would result in a different shape of the flexible foam 40.

With respect to hardness, the flexible foam 40 included in the pocket coil spring assembly 10 can, in some embodiments, have a hardness of at least about 10 N to no greater than about 80 N, as measured by exerting pressure from a plate against a sample of the material to a compression of at least 40% of an original thickness of the material at approximately room temperature (i.e., 21° C., to 23° C.), where the 40% compression is held for a set period of time as established by the International Organization of Standardization (ISO) 2439 hardness measuring standard. In some embodiments, the flexible foam 40 included in the pocket coil spring assembly 10 has a hardness of about 10 N, about 20 N, about 30 N, about 40 N, about 50 N, about 60 N, about 70 N, about 80 N, about 90 N, about 100 N, about 110 N, about 120 N, about 130 N, about 140 N, about 150 N, about 160 N, about 170 N, about 180 N, about 190 N, or about 200 N, to provide a desired degree of comfort and body-conforming or supporting qualities.

With respect to density, the flexible foam 40 included in the pocket coil spring assembly 10 can, in some embodiments, also have a density that assists in providing a desired degree of comfort and body-conforming qualities, as well as an increased degree of material durability. In some embodiments, the density of the flexible foam 40 included in the pocket coil spring assembly 10 has a density of no less than about 30 kg/m$^3$ to no greater than about 150 kg/m$^3$. In some embodiments, the density of the flexible foam 40 included in the pocket coil spring assembly 10 is about 15 kg/m$^3$, 20 kg/m$^3$, 25 kg/m$^3$, 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a flexible foam having a particular density will affect other characteristics of the foam, including its hardness, the manner in which the foam responds to pressure, and the overall feel of the foam, but it should be appreciated that a flexible foam having a desired density and hardness can readily be selected for a particular pocket coil spring assembly or application as desired. Regardless of the particular properties of the flexible foam 40, a user's body, or portion thereof, resting on the pocket coil spring assembly 10 will be supported by both the flexible foam 40 as well as the coil spring 20, however, because the top surface 42 of the flexible foam 40 extends above the coil spring 20, the user's body, or portion thereof, resting on the pocket coil spring assembly 10 will only contact the flexible foam 40 and not the coil spring 20. Accordingly, the exemplary pocket coil spring assembly 10 advantageously combines the contact feel of foam with the durability and support of a spring.

As previously stated, the flexible foam 40 in the exemplary embodiment shown in FIG. 1 is comprised of a two-part polyurethane foam, but it is appreciated that other materials can be used in addition to or instead of a foam, such as a gel or a fibrous fill material. For example, in some embodiments, the flexible foam can comprise, or can be replaced with, a vinyl- or silicone-based gel or other similar material. As another example, in some embodiments, the flexible foam can comprise an elastomeric gelatinous material that is capable of providing a cooling effect by acting as a thermal dump or heat sink into which heat from a user's body, or portion thereof, positioned on the flexible foam 40 can dissipate. More specifically, in these embodiments, the flexible foam comprises a polyurethane-based gel made by combining Hyperlast® LU 1046 Polyol, Hyperlast® LP 5613 isocyanate, and a thermoplastic polyurethane film, which are each manufactured and sold by Dow Chemical Company Corp. (Midland, Mich.), and which can be combined to produce a gel having a thermal conductivity of 0.1776 W/m*K, a thermal diffusivity of 0.1184 mm$^2$/s, and a volumetric specific heat of 1.503 MJ(/m$^3$K) as established by the International Organization of Standardization (ISO) 22007-2 volumetric specific heat measuring Standard.

Furthermore, it is appreciated that the wire gauge, spring constant, pre-compression, and overall geometry of the coil spring used in a particular pocket coil spring assembly can also be readily varied and used to impart a particular feel or characteristic in an exemplary pocket coil spring assembly without departing from the spirit and scope of the present invention.

Figure 2:
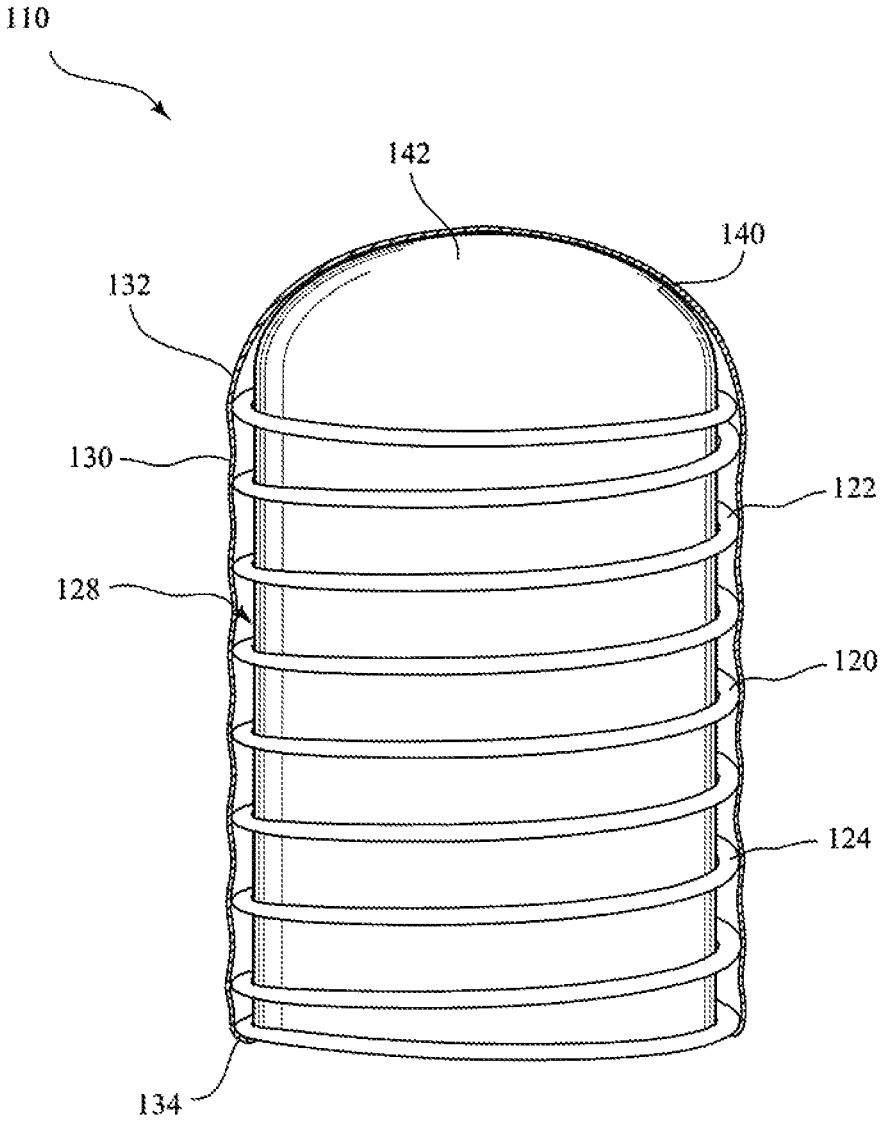
FIG. 2 is a side view of another exemplary pocket coil spring assembly made in accordance with the present invention with a portion of the fabric pocket of the pocket coil spring assembly removed to show a coil spring.

Referring now to FIG. 2, in another embodiment of the present invention, a pocket coil spring assembly 110 is provided that, similar to the pocket coil spring assembly 10 described above with reference to FIG. 1, includes a coil spring 120 having an upper portion 122 and a lower portion 124 which collectively define an interior cavity 128 of the coil spring 120. The pocket coil spring assembly 110 further includes a fabric pocket 130 that encases the coil spring 120 with a top area 132 that covers the upper portion 122 of the coil spring 120 and a bottom area 134 that covers the lower portion 124 of the coil spring 120. Further included in the pocket coil spring assembly 110 is an amount of flexible foam 140 that is positioned in the interior cavity 128 of the coil spring 120 and that has a top surface 142 that extends above the coil spring 120. However, unlike the pocket coil spring assembly 10 described above with reference to FIG. 1, in the exemplary pocket coil spring assembly 110 shown in FIG. 2, the flexible foam 140 fills substantially all of the internal cavity 128 of the coil spring 120 such that the fabric pocket 130 encases both the coil spring 120 and the flexible foam 140. In this regard, in the exemplary pocket coil spring assembly 110 shown in FIG. 2, the top area 132 of the fabric pocket 130 is also not connected to the bottom area 134 of the fabric pocket 130 within the internal cavity 128 of the coil spring 120, but instead, the top area 132 of the fabric pocket 130 spans across the top surface 142 of the flexible foam 140 above the coil spring 120. As such, and because the top surface 142 of the flexible foam 140 still extends above the coil spring 120, in the exemplary pocket coil spring assembly 110 shown in FIG. 2, a user's body, or portion thereof, resting on the pocket coil spring assembly 110 will still only contact the flexible foam 140 and not the coil spring 120 in order to provide the user with the contact feel of foam and the durability and support of a spring.

Figure 3:
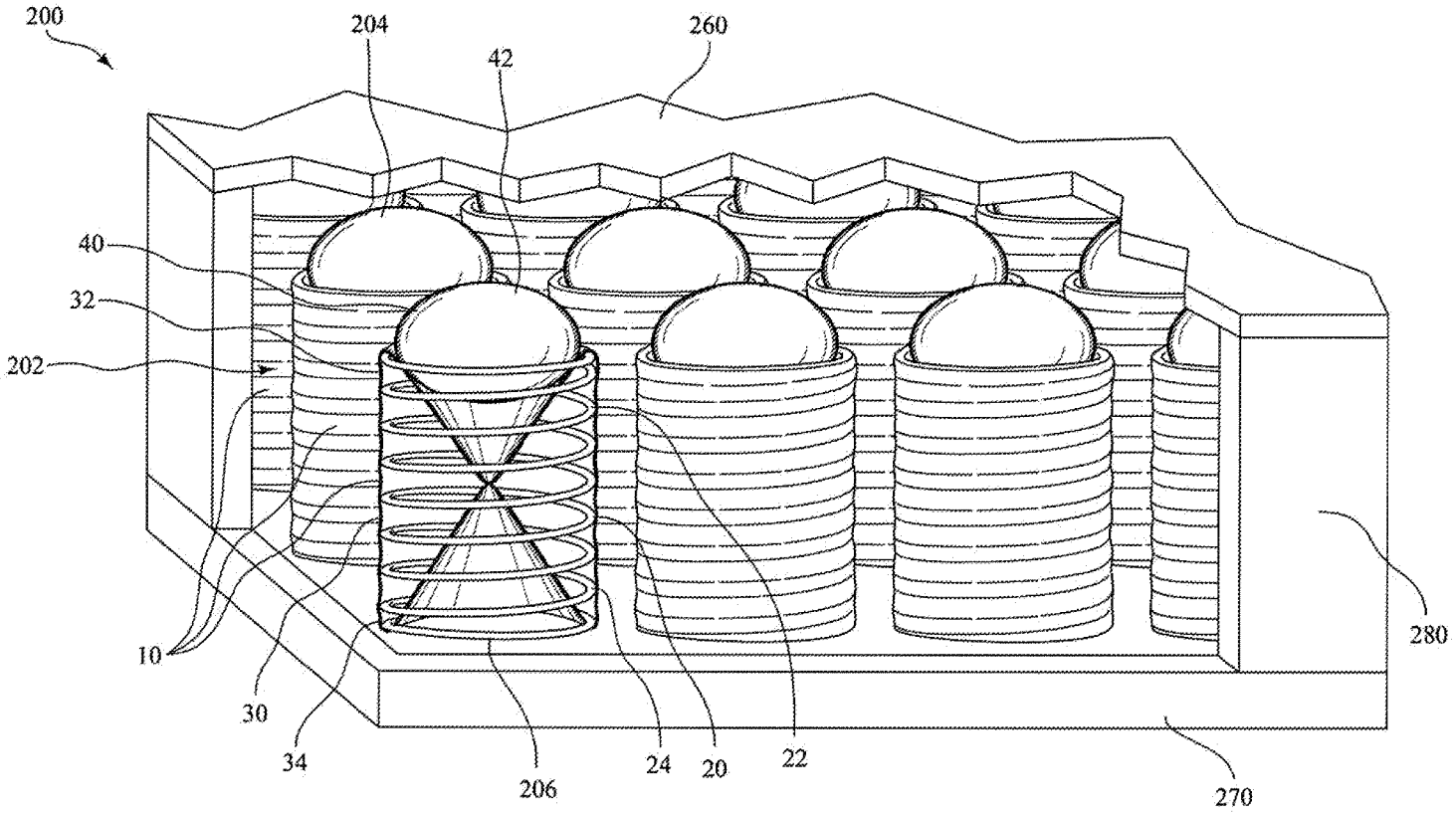
FIG. 3 is a perspective view of an exemplary mattress assembly made in accordance with the present invention with a portion of the mattress assembly removed to show a plurality of the pocket coil spring assemblies of FIG. 1 positioned in the interior of the mattress assembly.

Referring now to FIG. 3, in another embodiment of the present invention, an exemplary mattress assembly 200 is provided that comprises a plurality of the pocket coil spring assemblies 10 described above with reference to FIG. 1. As shown in FIG. 3, the pocket coil spring assemblies 10 are arranged in a matrix and collectively form a spring core 202 having a first support surface 204 (or sleep surface), and a second support surface 206 opposite the first support surface 204. In the spring core 202 shown in FIG. 3, the longitudinal axes of each of the pocket coil spring assemblies 10 are arranged parallel with one another and the pocket coil spring assemblies 10 are connected to one another. More specifically, the pocket coil spring assemblies 10 are connected to one another such that the top surface 42 of the flexible foam 40 of the pocket coil spring assemblies 10 forms, at least in part, the first support surface 204 of the spring core 202, and the bottom area 34 of the fabric pocket 30 along with the lower portion 24 of the coil spring 20 of each of the pocket coil spring assemblies 10 form the second support surface 206 of the spring core 202.

Referring still to FIG. 3, in addition to the spring core 202, the exemplary mattress assembly 200 further comprises an upper body supporting layer 260 positioned adjacent to the first support surface 204 of the spring core 202, along with a lower foundation layer 270 positioned adjacent to the second support surface 206 of the spring core 202. A side panel 280 extends between the upper body supporting layer 260 and the lower foundation layer 270 around the entire periphery of the spring core 202 such that the plurality of the pocket coil spring assemblies 10 are surrounded.

In the exemplary embodiment shown in FIG. 3, the upper body supporting layer 260 is comprised of a visco-elastic foam; however, it is contemplated that the upper body supporting layer 260 can also be comprised of some combination of foam, upholstery, and/or other soft, flexible materials known in the art. Furthermore, the upper body supporting layer 260 can be comprised of multiple layers of material configured to improve the comfort or support of the upper body supporting layer 260. In contrast to the upper body supporting layer 260, the lower foundation layer 270 is generally comprised of a piece of wood, or other similarly rigid member, and is configured to support the plurality of pocket coil spring assemblies 10.

Figure 4:
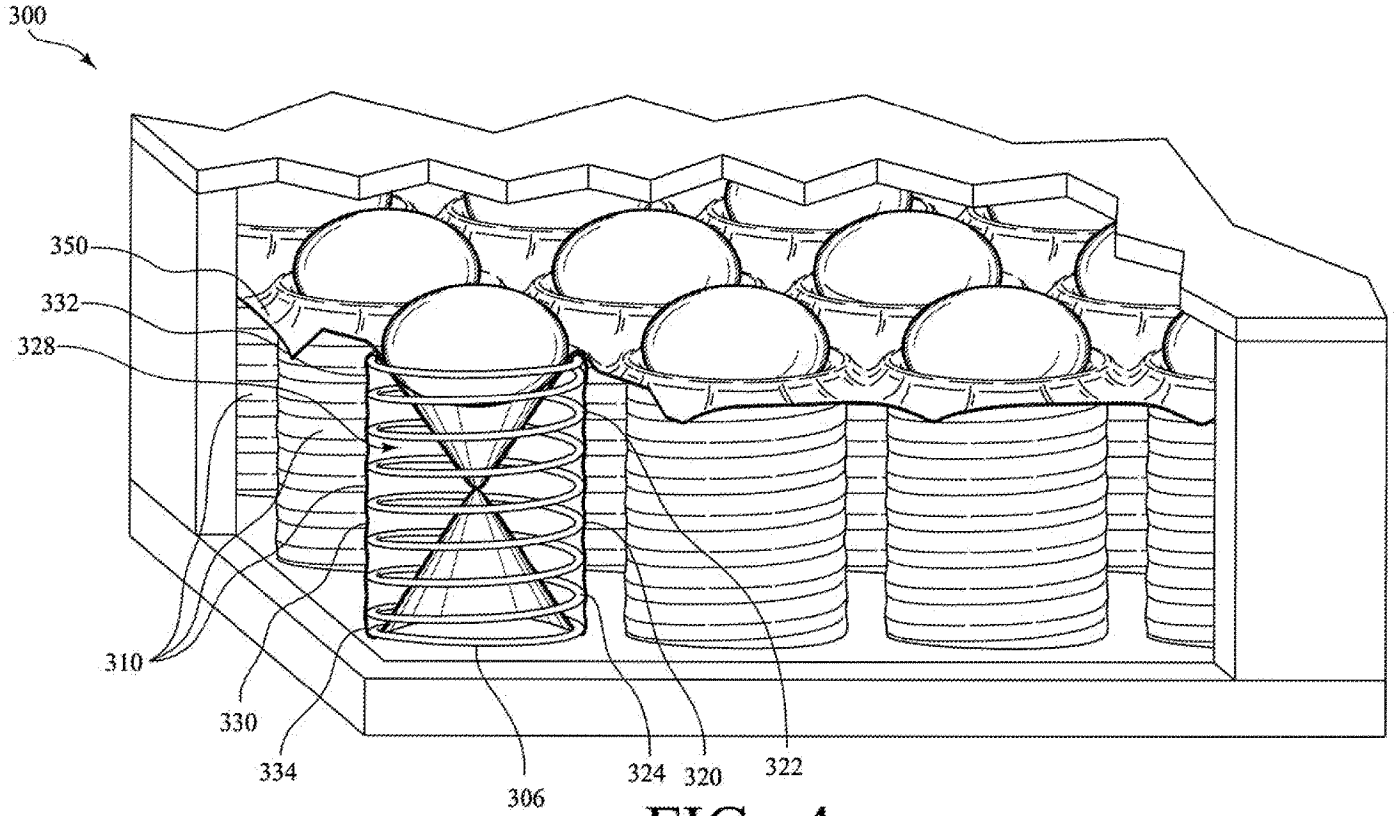
FIG. 4 is a perspective view of another exemplary mattress assembly made in accordance with the present invention with a portion of the mattress assembly removed to show a plurality of exemplary pocket coil spring assemblies positioned in the interior of the mattress assembly.

Referring now to FIG. 4, as a refinement to the present invention, an exemplary mattress assembly 300 is provided that is substantially similar to the mattress assembly 200 described above with reference to FIG. 3, but that further includes a continuous sheet 350 that connects a plurality of pocket coil spring assemblies 310. Specifically, and similar to the pocket coil spring assemblies 10 described above with reference to FIGS. 1 and 3, each of the pocket coil spring assemblies 310 shown in FIG. 4 includes a coil spring 320 having an upper portion 322 and a lower portion 324 which collectively define an interior cavity 328 of the coil spring 320. The pocket coil spring assemblies 310 further include a fabric pocket 330 that encases the coil spring 320 with a top area 332 that covers the upper portion 322 of the coil spring 320 and a bottom area 334 that covers the lower portion 324 of the coil spring 320. However, unlike the mattress assembly 200 described above with reference to FIG. 3, in the exemplary mattress assembly 300 shown in FIG. 4, the continuous sheet 350 extends across the upper portion 322 of each of the plurality of coil, springs 320 covering each of the plurality of coil springs 320. As shown in exemplary mattress assembly 300 in FIG. 4, a portion of the continuous sheet 350 forms, at least in part, the top area 332 of the fabric pocket 330 of each of the plurality of pocket coil spring assemblies 310. Of course, it is also contemplated that a plurality of pocket coil spring assemblies such as, for example, the pocket coil spring assemblies 10, 110 described above with reference to FIG. 1 or FIG. 2 can be arranged in a matrix and then covered by a continuous sheet, such that the continuous sheet is separate and distinct from the fabric pocket that encases each of the coil springs in the plurality of pocket coil spring assemblies. Furthermore, it is also contemplated that a plurality of pocket coil spring assemblies such as, for example, the pocket coil spring assemblies 10, 110 described above with reference to FIG. 1 or FIG. 2 can be arranged in a matrix and then connected together such that the top areas of the fabric pocket of each of the plurality of pocket coil spring assemblies collectively form a continuous sheet.

Figure 5:
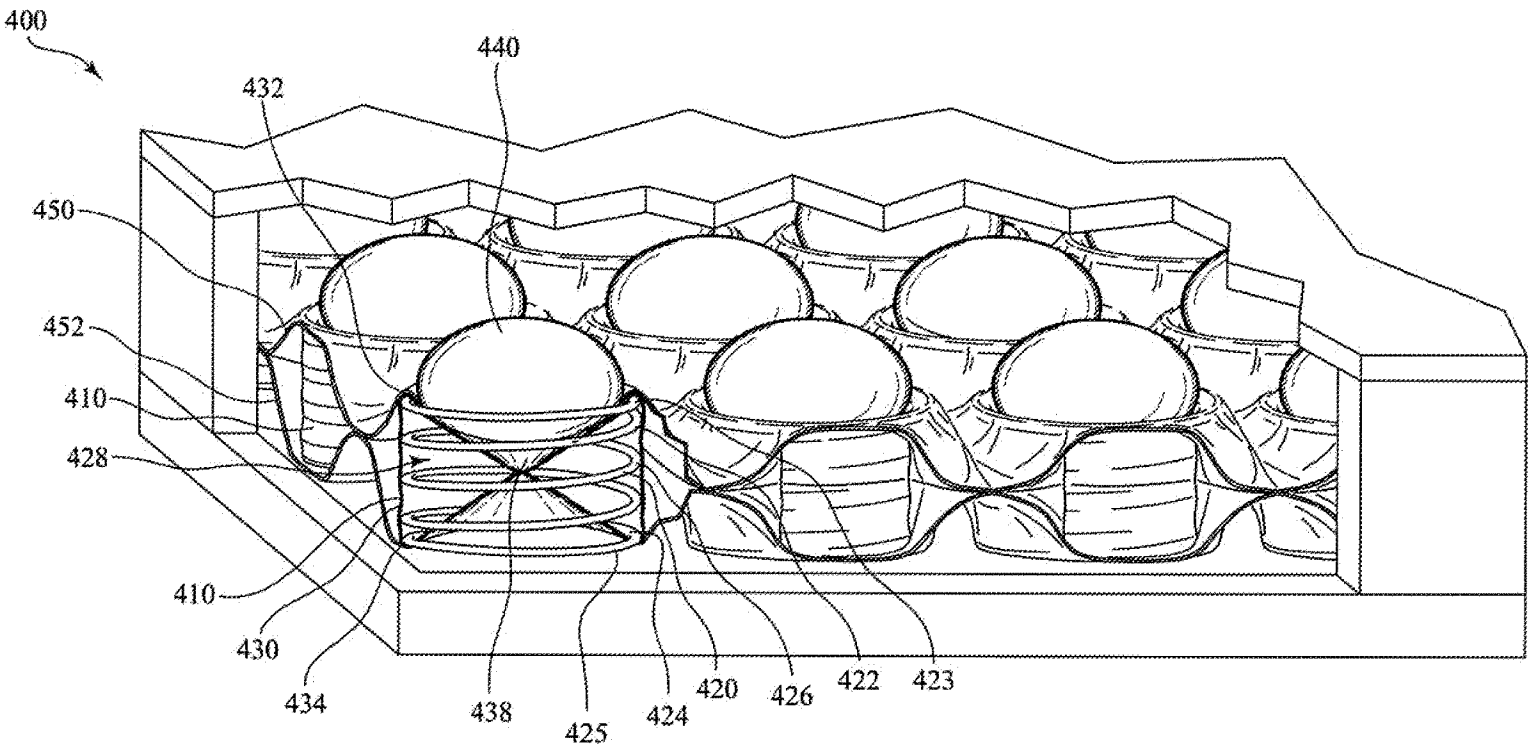
FIG. 5 is a perspective view of another exemplary mattress assembly made in accordance with the present invention with a portion of the mattress assembly removed to show a plurality of exemplary pocket coil spring assemblies positioned in the interior of the mattress assembly.

Referring now to FIG. 5, as a further refinement to the present invention, an exemplary mattress assembly 400 is provided which comprises a plurality of mini-pocket coil spring assemblies 410 that have a height that is substantially less than the height of the coil springs described above with reference to FIGS. 1-4. The exemplary mattress assembly 400 shown in FIG. 5 further includes both an upper continuous sheet 450 and a lower continuous sheet 452, which are described further below.

Similar to the pocket coil spring assemblies 10, 110, 310 described above with reference to FIGS. 1-4, each of the mini-pocket coil spring assemblies 410 shown in FIG. 5 include a coil spring 420 having an upper portion 422 and a lower portion 424 which collectively define an interior cavity 428 of the coil spring 420. Each coil spring 420 in FIG. 5 is also made of a continuous wire that extends from an upper end convolution 423 at the upper portion 422 of the coil spring 420 to a lower end convolution 425 opposite the upper end convolution 423 at the lower portion 424 of the coil spring 420, but unlike the coil springs 20, 120, 320 described above with reference to FIGS. 1-4, there are only three intermediate convolutions 426 that helically spiral between the upper end convolution 423 and the lower end convolution 425 such that each coil spring 420 shown in FIG. 5 is made of a total of five convolutions or turns and therefore has a height that is substantially less than the height of the coil springs 20, 120, 320 described above with reference to FIGS. 1-4.

The exemplary mattress assembly 400 shown in FIG. 5 further includes an upper continuous sheet 450 which extends across the upper portion 422 of each of the plurality of coil springs 420, and a lower continuous sheet 452 which extends across the lower portion 424 of each of the plurality of coil springs 420. The upper continuous sheet 450 is connected to the lower continuous sheet 452 around and between each of the plurality of coil springs 420, such that the upper continuous sheet 450 and the lower continuous sheet 452 collectively form a fabric pocket 430 that encases each of the coil springs 420. Specifically, a portion of the upper continuous sheet 450 forms, at least in part, the top area 432 of the fabric pocket 430 that covers the upper portion 422 of the coil spring 420 of each of the plurality of pocket coil spring assemblies 410. Similarly, a portion of the lower continuous sheet 452 forms, at least in part, the bottom area 434 of the fabric pocket 430 that covers the lower portion 424 of the coil spring 420 of each of the plurality of pocket coil spring assemblies 410. The upper continuous sheet 450 is also connected to the lower continuous sheet 452 within the interior cavity 428 of the coil spring 420 forming a recess 438 into which a flexible foam 440 can be directly dispensed and allowed to react and bond to the fabric pocket 430. Accordingly, the exemplary mattress assembly 400 and associated pocket coil spring assemblies 410 shown in FIG. 5 also advantageously combines the contact feel of foam with the durability and support of a spring.

Throughout this document, various references are mentioned. All such references are incorporated herein by reference.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A pocket coil spring assembly, comprising:

a coil spring having an upper portion and a lower portion, the upper portion and the lower portion collectively defining an interior cavity of the coil spring;

a fabric pocket encasing the coil spring, the fabric pocket including a top area covering the upper portion of the coil spring and a bottom area covering the lower portion of the coil spring; and an amount of flexible foam positioned in the interior cavity of the coil spring and having a top surface that extends above the coil spring, wherein a portion of fabric of the fabric pocket is disposed between the flexible foam and the coil spring.

2. The pocket coil spring assembly of claim 1, wherein the top area of the fabric pocket defines a recess extending into the interior cavity of the coil spring, and wherein the flexible foam is positioned in the recess.

3. The pocket coil spring assembly of claim 2, wherein the top area of the fabric pocket is connected to the bottom area of the fabric pocket within the interior cavity of the coil spring to thereby define the recess.

4. The pocket coil spring assembly of claim 3, wherein the coil spring has a height and the recess extends into the interior cavity of the coil spring to about half of the height of the coil spring.

5. The pocket coil spring assembly of claim 1, wherein the top surface of the flexible foam has a convex shape.

6. The pocket coil spring assembly of claim 1, wherein the fabric pocket further encases the flexible foam.

7. The pocket coil spring assembly of claim 6, wherein the amount of flexible foam is sufficient to fill substantially all of the interior cavity of the coil spring.

8. The pocket coil spring assembly of claim 1, wherein the fabric pocket is comprised of a non-woven textile.

9. The pocket coil spring assembly of claim 1, wherein the flexible foam is comprised of a visco-elastic foam.

10. The pocket coil spring assembly of claim 1, wherein the flexible foam is comprised of a gel.

11. The pocket coil spring assembly of claim 1, wherein the flexible foam is bonded to the fabric pocket.

12. A spring core, comprising:

a plurality of coil springs, each coil spring defining an interior cavity;

a continuous sheet covering each coil spring; and an amount of flexible foam positioned in the interior cavity of each coil spring, and having a top surface that extends above each coil spring, wherein at least a portion of said continuous sheet is disposed between the flexible foam and the coil spring.

13. The spring core of claim 12, wherein the continuous sheet defines a recess extending into the interior cavity of each coil spring, and wherein the flexible foam is positioned in each recess.

14. A mattress assembly, comprising:

a spring core having a first support surface and a second support surface opposite the first support surface, the spring core including a plurality of coil springs, each coil spring having an upper portion and a lower portion, the upper portion and the lower portion collectively defining an interior cavity of each coil spring, a plurality of fabric pockets, each fabric pocket encasing one of the coil springs, and including a top area covering the upper portion of each coil spring and a bottom area covering the lower portion of each coil spring, wherein the top area of the fabric pocket defines a recess extending into the interior cavity of the coil spring, and further wherein the top area of the fabric pocket is connected to the bottom area of the fabric pocket within the interior cavity of the coil spring;

an amount of flexible foam positioned in the recess in the interior cavity of each coil spring and having a top surface that extends above each coil spring;

an upper body supporting layer positioned adjacent to the first support surface of the spring core; and a lower foundation layer positioned adjacent to the second support surface of the spring core.

15. The mattress assembly of claim 14, wherein the top area of each fabric pocket defines a recess extending into the interior cavity of each coil spring, and wherein the flexible foam is positioned in each recess.

16. The mattress assembly of claim 14, wherein the top surface of the flexible foam has a convex shape.

17. The mattress assembly of claim 14, further comprising a continuous sheet covering the upper portion of each coil spring.

18. The mattress assembly of claim 17, wherein the flexible foam is positioned atop the continuous sheet.

19. The mattress assembly of claim 17, wherein for each fabric pocket, a portion of the continuous sheet forms the top area of the fabric pocket.

* * * * *